US009677357B2

(12) United States Patent
Harrington et al.

(10) Patent No.: US 9,677,357 B2
(45) Date of Patent: Jun. 13, 2017

(54) ANCHOR SLIP AND SEAL LOCKING MECHANISM

(71) Applicant: Baker Hughes Incorporated, Houston, TX (US)

(72) Inventors: Kevin E. Harrington, Houston, TX (US); Gregory L. Hern, Porter, TX (US); Yang Xu, Houston, TX (US)

(73) Assignee: Baker Hughes Incorporated

( * ) Notice: Subject to any disclaimer, the term of this patent is extended or adjusted under 35 U.S.C. 154(b) by 358 days.

(21) Appl. No.: 14/243,316

(22) Filed: Apr. 2, 2014

(65) Prior Publication Data

US 2014/0332205 A1 Nov. 13, 2014

Related U.S. Application Data

(60) Provisional application No. 61/821,830, filed on May 10, 2013.

(51) Int. Cl.

| | |
|---|---|
| ***E21B 12/00*** | (2006.01) |
| ***E21B 23/06*** | (2006.01) |
| ***E21B 21/10*** | (2006.01) |

(52) U.S. Cl.

CPC ..... *E21B 23/06* (2013.01); *E21B 21/103* (2013.01)

(58) Field of Classification Search

CPC ..... E21B 23/06

See application file for complete search history.

(56) References Cited

U.S. PATENT DOCUMENTS

| | | | | |
|---|---|---|---|---|
| 3,142,338 | A | 7/1964 | Brown | |
| 4,059,150 | A * | 11/1977 | Manderscheid | E21B 23/06 166/120 |
| 4,657,078 | A | 4/1987 | Fraser, III et al. | |
| 4,832,129 | A | 5/1989 | Sproul et al. | |
| 5,462,121 | A | 10/1995 | Schmuck et al. | |
| 5,553,672 | A | 9/1996 | Smith, Jr. et al. | |
| 6,481,496 | B1 * | 11/2002 | Jackson | E21B 33/128 166/120 |
| 6,860,326 | B2 * | 3/2005 | Kilgore | E21B 23/06 166/120 |
| 7,225,867 | B2 | 6/2007 | Mackenzie et al. | |
| 7,510,016 | B2 | 3/2009 | Telfer | |
| 8,087,458 | B2 | 1/2012 | Birner | |

(Continued)

OTHER PUBLICATIONS

Halliburton Brochure; "Inflow Tech Test Packer", 2011, 1 page.

*Primary Examiner* — Nicole Coy

(74) *Attorney, Agent, or Firm* — Steve Rosenblatt

(57) ABSTRACT

A test packer is lowered to a set liner hanger in a locked position that prevents the seal and slips from setting during running in. A first ball is dropped to shift a sleeve to release the grip of dogs to a groove on an outer housing. Setting down weight sets the test packer seal and sets the slips. After the casing integrity pressure test is done the test packer is lifted to again position the groove in the outer housing by the dogs. A second ball lands on the same seat now enlarged due to earlier movement and breaks a retainer on a locking sleeve. A spring return or continued downhole motion of the locking sleeve locks the packer in the run in position. Subsequent rotation and circulation can take place as completion fluid is circulated in. A circulation port above the packer can be opened optionally for circulation or reversing above the test packer.

20 Claims, 3 Drawing Sheets

(56) References Cited

U.S. PATENT DOCUMENTS

| | | | | |
|---|---|---|---|---|
| 2003/0201102 | A1 | 10/2003 | Mackenzie et al. | |
| 2012/0055681 | A1 | 3/2012 | Telfer | |
| 2012/0132438 | A1 | 5/2012 | Telfer | |
| 2012/0160523 | A1 | 6/2012 | Burgos | |
| 2012/0175108 | A1 | 7/2012 | Foubister et al. | |
| 2014/0138101 | A1* | 5/2014 | Arabsky | E21B 34/14 166/387 |

* cited by examiner

ANCHOR SLIP AND SEAL LOCKING MECHANISM

FIELD OF THE INVENTION

The field of the invention is completion methods and more particularly methods employing a packer settable on a liner hanger to test cement integrity by setting down weight followed by release with picking up and locking the packer with hydraulic force to allow string manipulation for subsequent fluid circulation with the packer locked from resetting.

BACKGROUND OF THE INVENTION

With a liner hung to the surrounding tubular it is desirable to do a cement integrity test by setting a packer on top of the liner hanger to isolate the liner hanger for a pressure test on the casing above. One potential problem with doing this is that the differential on the test packer transfers load to the seal on the liner hanger and can overstress the liner that is at the same time supported off the casing just below the liner hanger seal. In essence the liner hanger slips support the hanger seal and the test packer pushes down on the liner hanger seal against the support of the liner hanger slips with the result being a potential overstress of the top of the liner in the vicinity of the liner hanger seal.

To address this problem in the past the test packers being provided also had slips to dig into the casing to take the differential pressure load while isolating the load from the liner hanger seal. However, these packers generally operated mechanically with a j-slot in combination with drag blocks. The presence of drag blocks precluded reciprocation or rotation of the string supporting the test packer during subsequent operations because the drag block would rub the casing wall and erode the wall.

What is needed and provided by the present invention is a way to keep the test packer retracted for run in. The packer is hydraulically unlocked so that subsequent setting down force will extend the slips and set the packer seal for the test packer. The cement integrity test can then be run with the slips set in the casing so that the differential pressure load is not applied to the seal in the liner hanger. This protects the liner hanger from damage by overstressing. At the end of that test the string is picked up to stretch out the packer and to place locking dogs in alignment with a locking groove inside the outer housing. A second ball is dropped on a seat to break a restraint and move a sleeve to put the dogs in a secured position in the respective groove in the housing. This can be done with pressure simply moving a sleeve down or a return spring moving a sleeve up after initial downward movement breaks a shear device. At that point the string from the surface can be rotated or reciprocated as completion fluids are spotted. A circulation sub can have a port open above the test packer to continue with circulation or for reverse circulation while bypassing the liner. Those skilled in the art will more readily understand the present invention from a review of the description of the preferred embodiment and the associated drawings while recognizing that the full scope of the invention is to be determined by the appended claims.

SUMMARY OF THE INVENTION

A test packer is lowered to a set liner hanger in a locked position that prevents the seal and slips from setting during running in. A first ball is dropped to shift a sleeve to release the grip of dogs to a groove on an outer housing. Setting down weight sets the test packer seal and sets the slips. After the casing integrity pressure test is done the test packer is lifted to again position the groove in the outer housing by the dogs. A second ball lands on the same seat now enlarged due to earlier movement and breaks a retainer on a locking sleeve. A spring return or continued downhole motion of the locking sleeve locks the packer in the run in position. Subsequent rotation and circulation can take place as completion fluid is circulated in. A circulation port above the packer can be opened optionally for circulation or reversing above the test packer.

DETAILED DESCRIPTION OF THE PREFERRED EMBODIMENT

Figure 1:
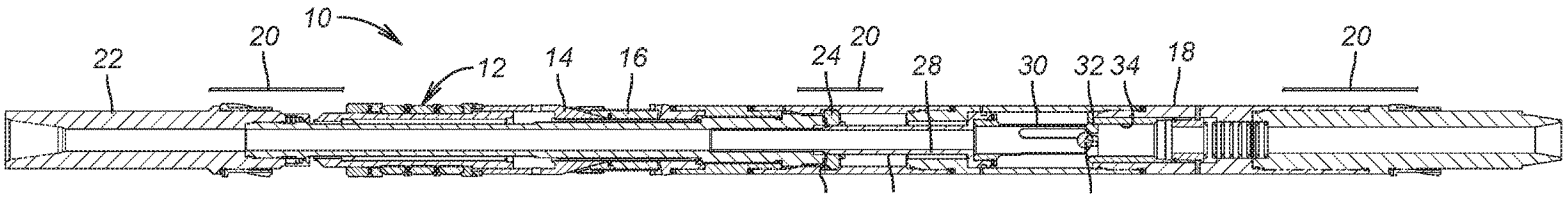
FIG. 1 is the run in position for the spring return variation of the present invention with a first ball thereafter landed on the collet heads.
Figure 2:
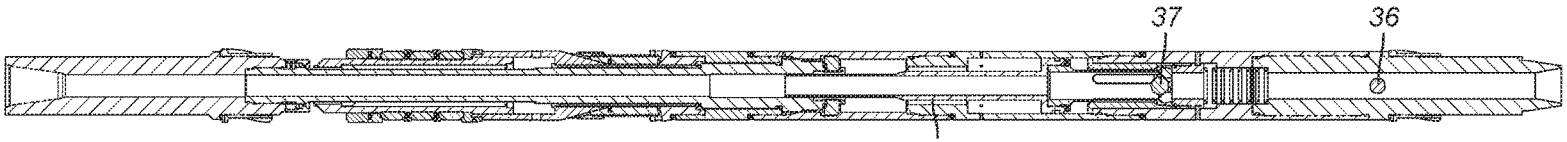
FIG. 2 is the view of FIG. 1 with the pressure applied on the first ball to unlock the dogs so that the packer can later set with setting down weight as well as the first ball released from axial shifting and a second ball landed on the collet heads.
Figure 3:
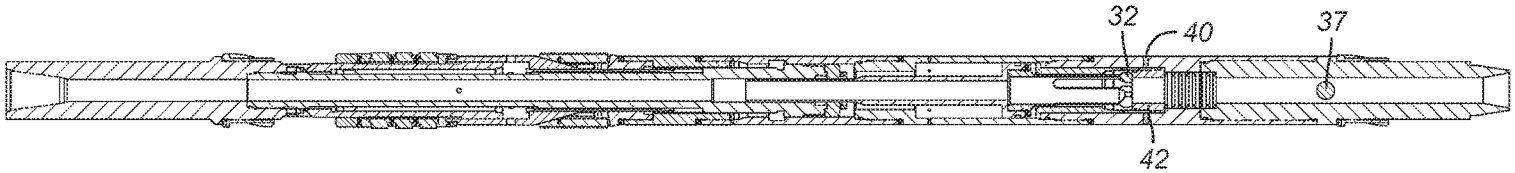
FIG. 3 is the view of FIG. 2 with the slips and seal set as well as the subsequent ball dropped after breaking a shear restraint on the lock sleeve all shown before the lock sleeve starts moving uphole under spring force.

Referring to FIG. 1, the packer 10 has a seal assembly 12 and a cone 14 that can wedge under slips 16. The outer housing 18 is run in until it finds support on a liner hanger that is not shown and that is hung off a liner hanger assembly that is also not shown that is set against the casing 20. The mandrel 22 is initially held to the outer housing 18 by dogs 24 extending into groove 26 and locked in that groove with sleeve 28. A series of collet fingers 30 terminate in heads 32 that are initially supported in multi-diameter sleeve 34 to form a seat for a ball 36 so that applying pressure on the seated ball 36 in FIG. 2 results in surface 38 moving away from dogs 24 so that setting down weight on mandrel 22 will allow for compression of the seal assembly 12 after the slips 16 are ramped out by cone 14. The packer is now set and the pressure integrity of the casing can be tested.

Figure 4:
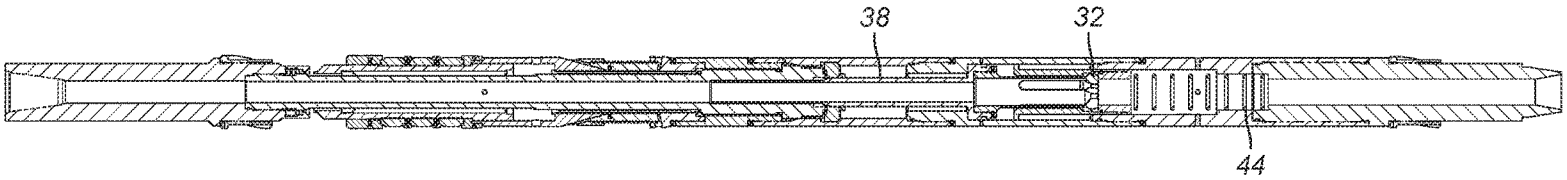
FIG. 4 is the view of FIG. 3 with the spring moving a sleeve uphole after picking up to align the locking groove with the dogs that then locks the dogs to a groove in the outer housing with the packer and slips retracted preventing another grip or seal by the test packer.
Figure 2A:
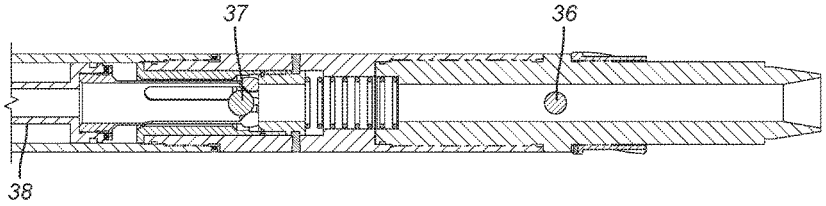
FIG. 2*a* is an enlargement of a part of FIG. 2.
Figure 3A:
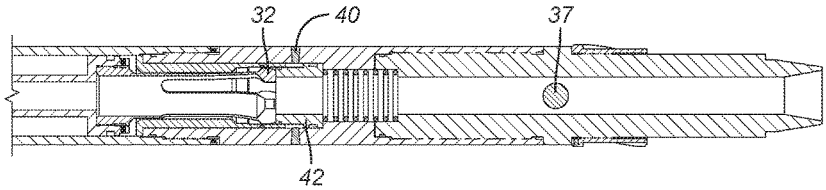
FIG. 3*a* is an enlargement of a s art of FIG. 3.
Figure 6A:
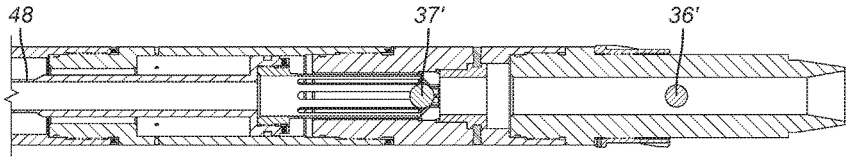
FIG. 6*a* is an enlargement of a part of FIG. 6.
Figure 8A:
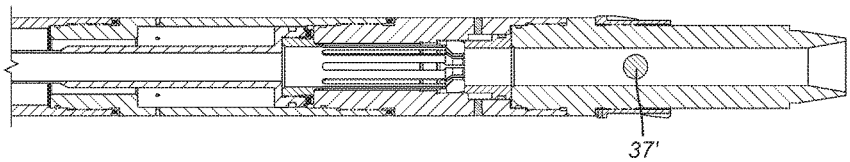
FIG. 8*a* is an enlargement of a cart of FIG. 8.
Figure 5:
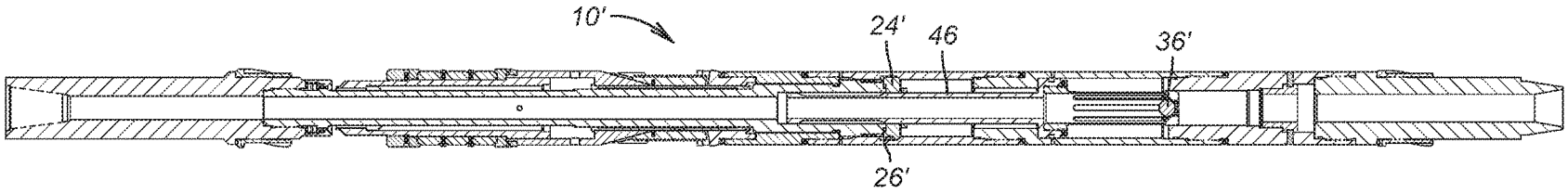
FIG. 5 is the run in position for the hydraulically driven sleeve variation of the present invention with a first ball thereafter landed on the collet heads.
Figure 6:
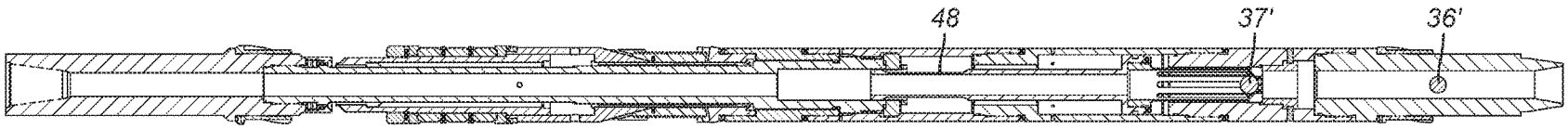
FIG. 6 is the view of FIG. 5 with the pressure applied on the first ball to unlock the dogs so that the packer can later set with setting down weight as well as the first ball released from axial shifting and a second ball landed on the collet heads.
Figure 7:
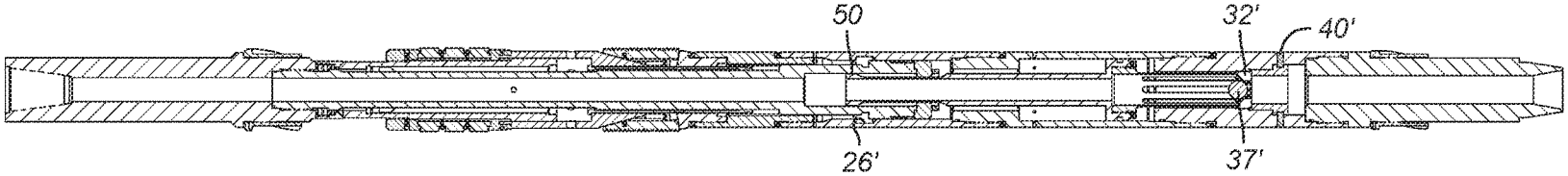
FIG. 7 is the view of FIG. 6 with the slips and seal set as well as the subsequent ball still-landed for pressure buildup to break a shear restraint on the lock sleeve all shown before the lock sleeve starts moving downhole for the lock position.
Figure 8:
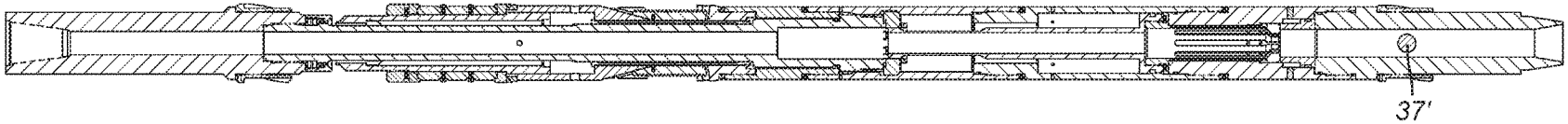
FIG. 8 is the view of FIG. 7 showing the tool picked up and the sleeve moved uphole to lock the dogs that are now in alignment with the locking groove due to picking up and the subsequent ball passing the collet heads.

When it is time to unset and lock the packer 10 in the retracted position, the mandrel 22 is picked up to get the groove 26 into axial alignment with dogs 24. A second and larger ball 37 is dropped on heads 32 that have now moved to a second location as the first ball 36 moved them axially to pass through. The pressure builds to break shear pin 40 pushing the heads 32 further down so they can open to release the larger ball that is not shown and shift the sleeve 42. The axial movement of heads 32 lets them open further to let the second and larger ball through. The spring 44 can then push the surface 38 against the dogs 24 when the dogs 24 are in groove 26 as shown in FIG. 4. Now the mandrel 22 is locked against relative movement with respect to the outer housing 18 and the packer 10 cannot set even if landed on a support and weight is set down. Now the completion process can continue in the same trip with completion fluid delivered through mandrel 22 while the work string is rotated and/or reciprocated to facilitate the delivery of completion fluid. A circulating sub that is not shown can be located above the packer 10 and operated with a combination of axial and rotational movement to open a circulation port above the packer 10 for circulation or reverse circulation down to that location.

The embodiment of FIGS. 5-8 works the same way except there is no return spring 44. Instead, surface 46 holds the dogs 24' in the locked position initially in groove 26'. Dropping ball 36' then positions recessed surface 48 opposite dogs 24' and setting down weight will now set the packer 10'. To lock the packer 10' in the released position a second ball 37' is dropped on the collet heads 32' that have already shifted axially to release the first ball 36' and are now supported to take a larger ball 37' for a second movement after breaking the shear member 40' that will result in putting raised surface 50 behind the dogs 24' since picking up before pressuring up a second time allowed the dogs 24' to get axially aligned with groove 26' and the second shifting move in the downhole direction has brought raised surface 50 behind the dogs 24' to trap them in groove 26'. The work string supporting the packer 10' can now be rotated and reciprocated for the subsequent completion operation where completion fluid is then introduced in the same trip. As before a circulation sub that is not shown can be added above the packer 10' to allow circulation and/or reverse circulation above the packer 10' as needed.

Those skilled in the art will appreciate that no drag blocks are used that could damage the casing when later rotating and/or reciprocating on subsequent completion steps. The lock system is enabled with fluid pressure and is previously disabled after running in with fluid pressure. The ball seat is shiftable to accommodate two ball landings while letting the balls pass to accomplish the initial unlocking or the relocking after the casing pressure integrity test is completed. This then locks the packer so it can be rotated and/or reciprocated to facilitate further completion operations in the same trip. The use of slips in the packer keeps the load off the liner hanger so the risk of overstressing the liner top at the seal of the liner hanger is avoided.

The above description is illustrative of the preferred embodiment and many modifications may be made by those skilled in the art without departing from the invention whose scope is to be determined from the literal and equivalent scope of the claims below:

We claim:

1. A lock assembly for a subterranean tool, comprising:

a mandrel supporting an outer assembly for selective relative movement therebetween;

a lock comprising a movable sleeve and a plurality of attached collet heads configured to releasably engage at least one object delivered to said mandrel, said movable sleeve selectively retaining at least one dog extending into said mandrel and said outer assembly for preventing relative movement therebetween for running in;

said movable sleeve and said at least one object located on said plurality of collet heads movable in tandem with pressure applied to remove support for said at least one dog to permit relative movement between said mandrel and said outer assembly for operation of the tool after running in;

said plurality of collet heads movable axially into a first surrounding supporting diameter, thus releasing said at least one object, enabling said relative movement between said mandrel and said outer assembly, and enabling engagement of at least another object on said collet heads;

said plurality of collet heads further movable into a second surrounding supporting diameter, which is larger than said first surrounding supporting diameter, thus enabling said at least another object to pass through said plurality of collet heads and enabling locking of said mandrel and said outer assembly against said relative movement; and said movable sleeve further movable to return to a supporting position for said dog extending into said mandrel and said outer assembly to prevent subsequent relative movement between said mandrel and said outer assembly in response to a mechanical force applied to either said mandrel or said outer assembly.

2. The lock assembly of claim 1, wherein:

said movable sleeve is actuated at least in part by a potential energy force.

3. The lock assembly of claim 2, wherein:

said potential energy source comprises a spring.

4. The lock assembly of claim 3, wherein:

the force of said spring is initially restrained by a spring sleeve in said outer housing retained with a breakable retainer.

5. The lock assembly of claim 4, wherein:

said movable sleeve initially moved with said at least one object landing on a seat formed by said plurality of attached collet heads such that applied pressure on said at least one object positions a recess on said movable sleeve opposite said at least one dog to release said mandrel and outer assembly for relative movement that sets the tool.

6. The lock assembly of claim 1, wherein:

said movable sleeve is actuated for multiple movements with respect to said at least one dog.

7. The lock assembly of claim 6, wherein:

said movable sleeve movements are in opposed directions with respect to said at least one dog.

8. The lock assembly of claim 6, wherein:

said movable sleeve movements are in the same direction with respect to said at least one dog.

9. The lock assembly of claim 8, wherein:

said movable sleeve movements are in response to discrete pressure applications in a passage of said mandrel.

10. The lock assembly of claim 9, wherein:

said movable sleeve initially moved with a said at least one object landing on a seat formed by said plurality of attached collet heads such that applied pressure on said at least one object positions a recess on said movable sleeve opposite said at least one dog to release said mandrel and outer assembly for relative movement that sets the tool.

11. A lock assembly for a subterranean tool, comprising:

a mandrel supporting an outer assembly for selective relative movement therebetween;

a lock selectively retaining said mandrel to said outer assembly to selectively prevent operation of the tool in a first position for running in;

said lock selectively movable to a second position to permit relative movement between said mandrel and said outer assembly for operation of the tool after running in;

said lock further movable to return to said first position from said second position to prevent further operation of the tool;

said lock is actuated between said positions at least in part with pressure applied in a passage in said mandrel;

said lock is actuated between said positions with multiple movements of an actuation sleeve with respect to at least one locking dog;

said actuation sleeve movements are in opposed directions with respect to said at least one locking dog;

said movement of said actuation sleeve from said first to said second position of said lock is in response to pressure applied in said mandrel passage and movement of said actuation sleeve from said second to said first position of said lock is under force of a return spring;

the force of said return spring is initially restrained by a spring sleeve in said outer housing retained with a breakable retainer;

said actuation sleeve initially moved with a first object landing on a seat such that applied pressure on said first object positions a recess on said actuation sleeve opposite said dog to release said mandrel and outer assembly for relative movement that sets the tool;

said first object passes through said seat as said seat and actuation sleeve move in tandem.

12. The lock assembly of claim 11, wherein:

said seat is reconfigured to accept a second object due to said tandem movement.

13. The lock assembly of claim 12, wherein:

said second object is larger than said first object.

14. The lock assembly of claim 13, wherein:

applied pressure on said second object breaks said breakable retainer to allow said return spring to move said spring sleeve against said seat to reposition said actuation sleeve in a supporting relation to said dog for resumption of said first position of said lock.

15. The lock assembly of claim 14, wherein:

said assembly comprises the tool and said tool further comprises a packer.

16. A lock assembly for a subterranean tool, comprising:

a mandrel supporting an outer assembly for selective relative movement therebetween;

a lock selectively retaining said mandrel to said outer assembly to selectively prevent operation of the tool in a first position for running in;

said lock selectively movable to a second position to permit relative movement between said mandrel and said outer assembly for operation of the tool after running in;

said lock further movable to return to said first position from said second position to prevent further operation of the tool;

said lock is actuated between said positions at least in part with pressure applied in a passage in said mandrel;

said lock is actuated between said positions with multiple movements of an actuation sleeve with respect to at least one locking dog;

said actuation sleeve movements are in the same direction with respect to said at least one locking dog;

said actuation sleeve movements are in response to discrete pressure applications in said passage of said mandrel;

said actuation sleeve initially moved with a first object landing on a seat such that applied pressure on said first object positions a recess on said actuation sleeve opposite said dog to release said mandrel and outer assembly for relative movement that sets the tool;

said first object passes through said seat as said seat and actuation sleeve move in tandem.

17. The lock assembly of claim 16, wherein:

said seat is reconfigured to accept a second object due to said tandem movement.

18. The lock assembly of claim 17, wherein:

said second object is larger than said first object.

19. The lock assembly of claim 18, wherein:

pressure applied to said second object located on said seat further moves said actuating sleeve in the same direction as said initial movement so that said actuating sleeve supports said dogs to lock said mandrel and outer assembly together for said first position of said lock.

20. The lock assembly of claim 19, wherein:

said assembly comprises the tool and said tool further comprises a packer.

* * * * *